US005934957A

United States Patent [19]

Sato et al.

[11] Patent Number: 5,934,957

[45] Date of Patent: Aug. 10, 1999

[54] OUTBOARD MOTOR

[75] Inventors: Takuya Sato, Hamamatsu; Mitsuhiko Ohta, Shizuoka-Ken; Masashi Takayanagi, Shizuoka-Ken; Naoki Kawasaki, Shizuoka-Ken, all of Japan

[73] Assignee: Suzuki Motor Corporation, Japan

[21] Appl. No.: 08/964,373

[22] Filed: Nov. 6, 1997

[30] Foreign Application Priority Data

Jan. 31, 1997 [JP] Japan ..... 9-019462

[51] Int. Cl.[6] ..... B63H 21/38

[52] U.S. Cl. ..... 440/88; 440/89

[58] Field of Search ..... 440/88, 89; 123/196 R; 60/312, 314, 320, 322

[56] References Cited

U.S. PATENT DOCUMENTS 5,149,284 9/1992 Kawai ..... 440/88

5,232,387 8/1993 Sumigawa ..... 440/89

5,439,404 8/1995 Sumigawa ..... 440/88

5,634,833 6/1997 Watanabe ..... 440/88

*Primary Examiner*—Jesus D. Sotelo

*Attorney, Agent, or Firm*—Finnegan, Henderson, Farabow, Garrett & Dunner, L.L.P.

[57] ABSTRACT

An outboard motor having an oil pan positioned on the underside of the engine, and having an exhaust passage, a water supply passage for cooling water, and a wastewater passage extending down from the engine and passing near the oil pan. The exhaust passage, the water supply passage, and the wastewater passage are molded as a single unit with the oil pan, and provide a simple, lightweight structure that does not result in an increase in the number of parts or assembly man hours necessary for construction. The oil pan is protected from exhaust heat by the water passages, and a flush port to clean the cooling system is easily accessible.

6 Claims, 10 Drawing Sheets

OUTBOARD MOTOR

BACKGROUND OF THE INVENTION

This invention relates to outboard marine motors, and, more particularly, to an outboard motor which utilizes for cooling water obtained from the body of water in which the motor operates.

Typical outboard motors which include a four-cycle engine have an oil pan located under the engine containing the oil used to lubricate the interior of the engine. An exhaust passage used to carry fumes from the exhaust manifold, a cooling water supply passage and a waste water passage extending downward from the engine, are also located near the oil pan.

In conventional outboard motors, each of these passages is provided by separate pipes, firmly bolted to the underside of the engine near the oil pan, or to a part that acts as the engine base.

Outboard motors have a pipe open to the outside for intake of seawater, river water, or lake water which is used to cool the engine. As a result, dirt tends to accumulate in water jackets inside the engine and in cooling water passages, wastewater passages, and in other coolant passages. Over time, the flow of cooling water can be obstructed by the dirt. Thus, a flush port is provided along the cooling water passage to enable cleansing the cooling water passage with clean water. A hose from an outside clean water supply is inserted into the flush port to remove dirt from the interior of the cooling water pathway. In conventional outboard motors, the flush port is usually located inside the engine.

A problem exists in conventional outboard motors because these motors are assembled using separate pipes for the exhaust passage, the cooling water passage, and the wastewater passage. A great number of parts, such as gaskets and fasteners, are needed to maintain sealed connections between different pipes and between members making up the pipes. These conventional designs require a large number of parts, and have a complex structure, leading to an increase in assembly man hours, production costs, and weight of the outboard motor.

In outboard motors of conventional designs, the heat of exhaust gas flowing in the exhaust passage located near the oil pan heats the oil accumulated in the oil pan. This causes serious problems in the form of reduced life span and lubrication performance of the oil. In addition, the bolts that attach the pipes of the exhaust passage to the underside of the engine or to the engine base deteriorate materially because of the exhaust heat. This heating results in bending damage to the bolts.

Another problem found in conventional designs, is that when the water pressure in the cooling water pathway increases beyond what is required to cool the engine, an added load is placed on the gaskets securing the connections between components of the cooling system. This results in cooling water leaking from the connections.

Conventional designs also have a flush port used to wash the cooling water pathway with clean water. The flush port is placed on the engine itself, and requires complicated piping leading to the flush port, thus increasing the number of parts required and the number of man hours to assemble the motor. Because the entire engine is covered by an engine cover, the engine cover has to be taken off to use the flush port, increasing the complexity of flushing the engine.

Thus, there is a need for an outboard motor which overcomes the problems and limitations of the conventional art.

SUMMARY OF THE INVENTION

Accordingly, an object of the present invention is to provide an outboard motor that addresses the problems, limitations, and disadvantages of conventional designs.

Another objective of the invention is to provide an exhaust passage, a water supply passage for cooling water, and a waste water passage, all extending down from the engine through an oil pan section, by using a simple and lightweight structure that does not cause an increase in the number of parts and of man hours required to assemble the motor. the invention also avoids a need for separate pipes for the various passages, and does not require valve components, fixing bolts used as fasteners, gaskets that ensure airtightness, and other similar parts used in conventional motors.

A further objective of the outboard motor of the present invention is to prevent the reduction in life span and lubrication performance of the oil due to excessive heating, by arranging the components so that oil accumulated in the oil pan is unaffected by exhaust heat. Cooling water that flows through the water supply passage and through the waste water passage is used to shield the oil accumulated in the oil pan from the heat of the exhaust gases flowing within the exhaust passage, and thereby preserves the life span and lubrication performance of the oil.

A still further objective of the outboard motor of the present invention is to prevent water pressure in the cooling water pathway from exceeding preset limits, thus diminishing the loading on gaskets which can lead to cooling water leakage, by locating a pressure relief valve immediately downstream of the water pump, so that water pressure in the overall cooling water pathway cannot exceed preset limits, the loading placed on gaskets in the cooling system can be reduced, and cooling water leakage can be prevented.

Still another objective of the outboard motor of the present invention is to protect from exhaust gases the pressure relief valve that regulates the water pressure in the cooling water pathway, while at the same time preventing obstruction by exhaust gases of the flow of water discharged from the pressure relief valve, to ensure that the relief capabilities of the pressure relief valve are fully utilized. Direct contact of exhaust gas with the pressure relief valve located in the pressure valve chamber is avoided, so that the valve is shielded against exhaust gas, and the flow of water discharged from the pressure valve is not obstructed by the exhaust gas.

A still further objective of the outboard motor of the present invention is to simplify the structure surrounding the flush port used to wash the cooling water passage, and to simplify the flushing operation by providing the flush port used to clean the cooling water pathway in the oil pan, and exposing a plug to seal off the flush port in an externally accessible location.

To achieve these objectives and other advantages in accordance with the purpose of the present invention, as embodied and broadly described herein, the invention provides an outboard motor comprising an engine having an exhaust manifold, an inlet to receive cooling water to cool the engine, and an outlet to release waste water after it has been used in the engine. The motor also has an oil pan beneath the engine which includes a tank for holding oil, an exhaust passage communicating with the exhaust manifold, a cooling water passage communicating with the inlet, and a waste water passage communicating with the outlet. The passages are adjacent the tank for holding oil, and are formed as a single unit with the oil pan.

It is to be understood that both the foregoing general description and the following detailed description are exemplary and explanatory, and are intended to provide further explanation of the invention as claimed.

BRIEF DESCRIPTION OF THE DRAWINGS

The accompanying drawings are included to provide a further understanding of the invention and are incorporated in and constitute a part of the specification, illustrate one embodiment of the invention, and together with the description serve to explain the principles of the invention. In the drawings.

DESCRIPTION OF THE PREFERRED EMBODIMENT

Reference will now be made in detail to the present preferred embodiment of the invention, an example of which is described in the accompanying specification and/or illustrated in the accompanying drawings.

While the present invention can be broadly applied in the field of outboard motors, it is especially well suited for use in outboard motors that are cooled by water obtained from the surroundings of the motor.

Figure 1:
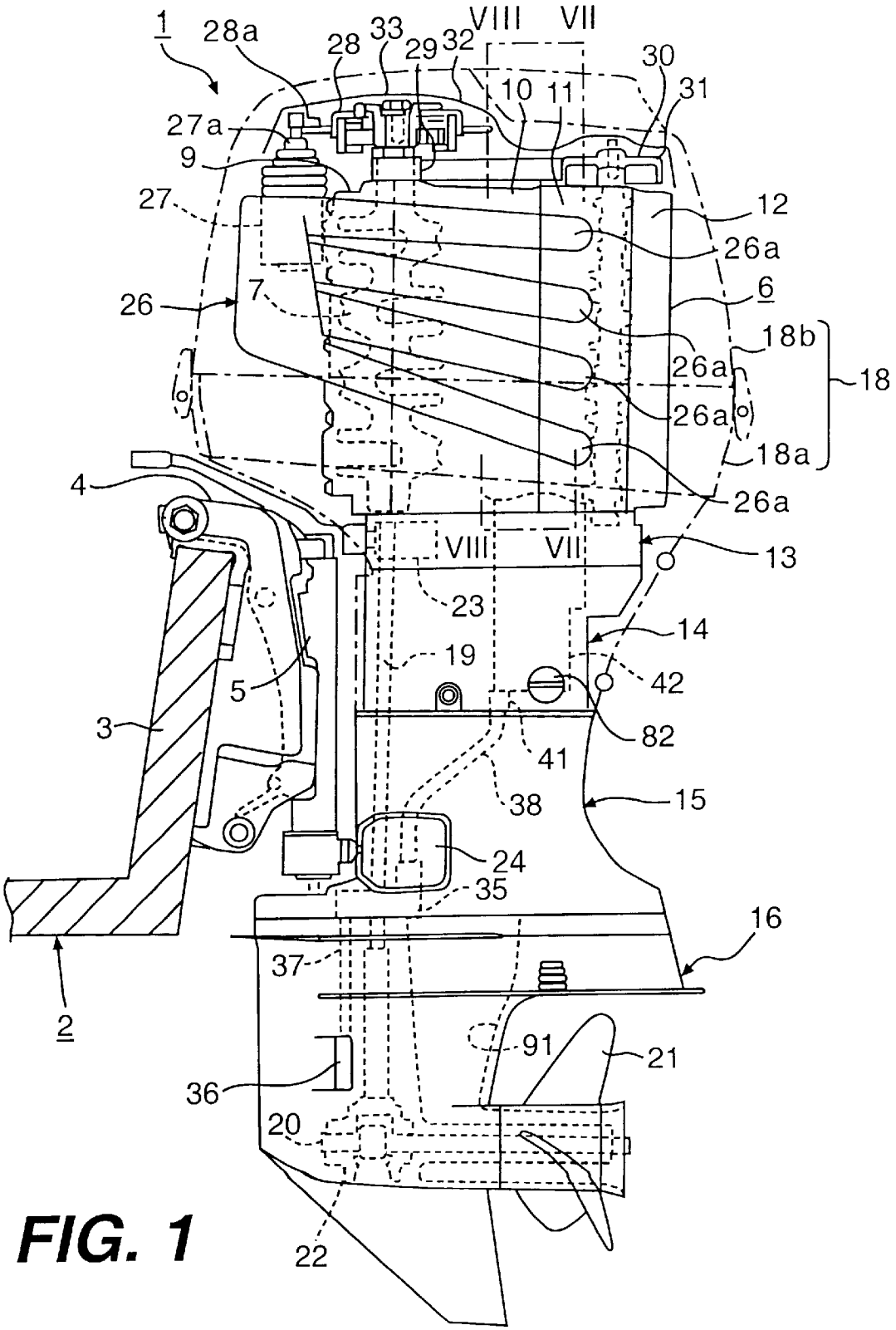
FIG. 1 is a left side elevation view showing one embodiment of an outboard motor according to the present invention.

As shown in FIG. 1, the outboard motor (1) is mounted to a transom (3) of a boat (2) via a clamp bracket (4), and can rotate freely left and right using as an axle the pilot shaft (5) provided vertically on the rear of the clamp bracket (4).

The engine (6) housed in the uppermost part of the outboard motor (1) is, for example, a water cooled, four-cycle gasoline engine with a straight bank of four cylinders. The crank shaft (7) of the engine is housed vertically, so that it faces the boat at a right angle. The clamp case (9), the cylinder block (10), the cylinder head (11), the head cover (12),and the associated components of engine (6) are arranged longitudinally.

An oil pan (14) is fixed to the bottom part of the engine (6) by way of an engine holder (13), that has the shape of a thick plate. A drive shaft housing (15) is fixed to the bottom of the oil pan (14) and, furthermore, a gear housing (16) is fixed to the bottom of the drive shaft housing.

The engine (6), engine holder (13), and oil pan (14) are covered by an engine cover (18), which can be separated in two parts along a horizontal line. The engine cover (18) includes a fixed lower cover **(18*a*) extending across engine holder (13) and oil pan (14), and an upper cover (18*b*) which can be removed from the lower cover. Maintenance on the engine (6) is done by removing the upper cover (18*b*)**.

The bottom end of the crankshaft (7) of the engine (6) is connected to the downward extending drive shaft (19) to form a single rotating body. Drive shaft (19) passes through the engine holder (13), the oil pan (14), and the interior of the drive shaft housing (15), and finally reaches the interior of gear housing (16).

A propeller shaft (20) extending horizontally inside the gear housing (16) is axially supported, and at one end is provided with a propeller (21). Rotation of the drive shaft (19) is transmitted to the propeller shaft (20) by means of a bevel gear mechanism (22), provided at the point of intersection of the drive shaft (19) and the propeller shaft (20).

The front edge of engine holder (13) and of the drive shaft housing (15) are provided with pairs of left and right mounting members (23, 24), through which the top and bottom ends of swivel shaft (5) can support the outboard motor (1). In this manner the motor can be attached to a boat.

An air intake device (26) is provided on the left side surface of the engine (6), and a starter motor (27) used for starting is provided on the front side of the engine. The top end of the crank shaft (7) protrudes further upward than the top surface of the engine (6), and a flywheel (28) is connected to the crank shaft to form a single rotating body with the crank shaft. A driver pulley (29) is provided at the bottom of the flywheel (28).

A cam shaft (30) parallel to the crank shaft (7) is supported axially within the cylinder head (11). The top end of the cam shaft protrudes from the top surface of the engine (6), and a driven pulley (31) is attached to the cam shaft to form a single rotating body with the cam shaft.

A timing belt (32) extends between the driver pulley (29) of the crank shaft and the driven pulley (31) of the cam shaft. The timing belt (32), functions to transmit rotation of the crank shaft (7) to the cam shaft (30), and a valve activating device located inside the cylinder head (11) (not shown in the figure) operates the valves with proper timing.

At the periphery of the flywheel (28) there is a ring gear **(28*a*). When the starter motor (27) is turned on, the pinion gear (27*a*) of the starter motor (27) protrudes up and engages the ring gear (28*a*), to rotate the crank shaft (7)**, and start the engine.

Also, the starter motor (27), the flywheel (28), the driver pulley (29), the driven pulley (31), the timing belt (32), and other components are covered from the top down by a cover component (33) made of a synthetic resin or similar material. Any water that pours down from above is blocked by the cover material (33), to protect the various engine components against water damage.

A water pump (35) is provided on the top surface of the gear housing (16). The drive shaft (19) also acts as the drive axle for water pump (35). A water intake opening (36) is provided on the side of the gear housing (16), and the water intake passage (37) extends up from this point and is connected to the water pump (35). Also, the upper end of the water supply pipe (38) extending up from the water pump (35) is connected to the underside of the oil pan (14).

Figure 2:
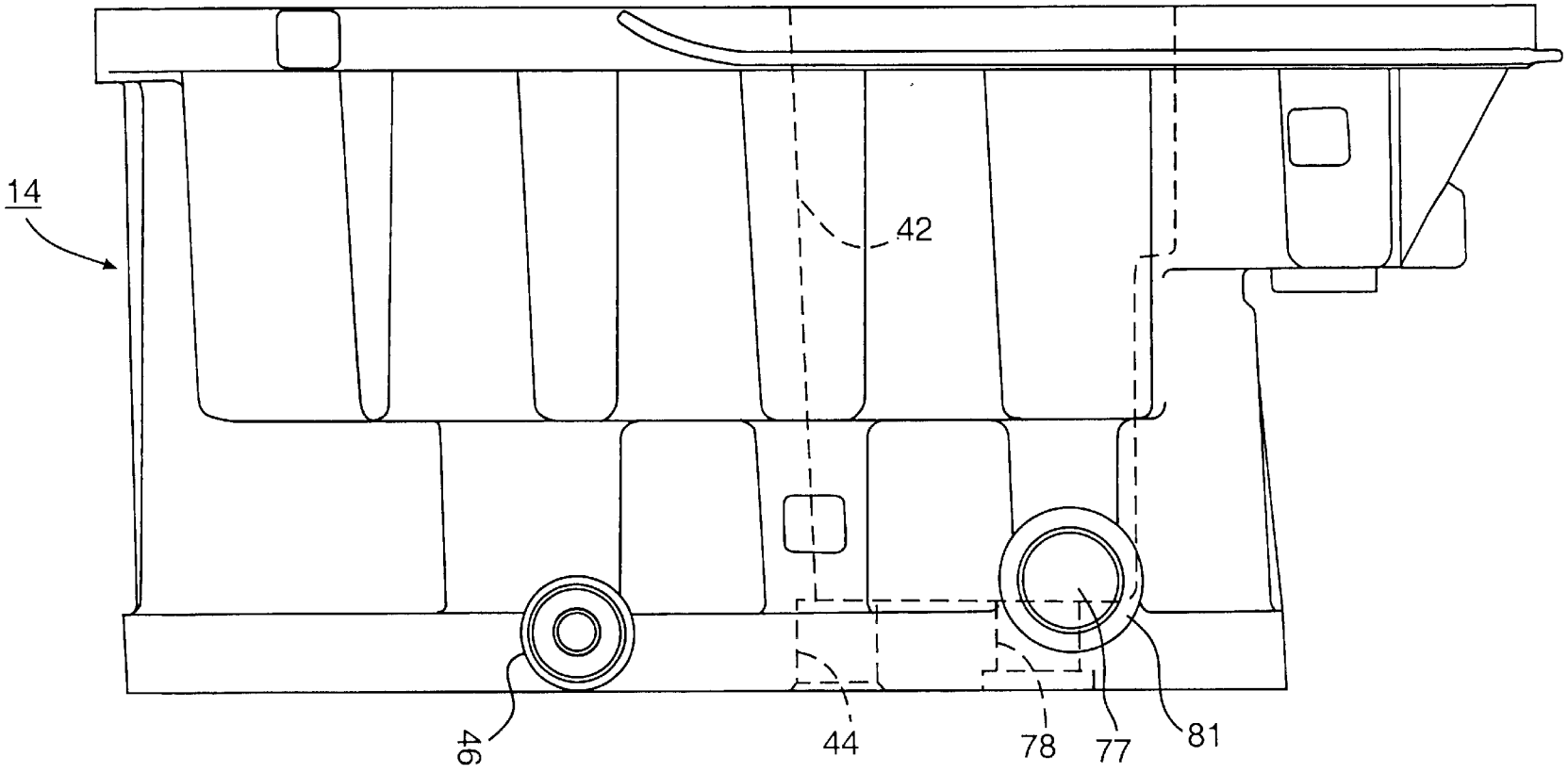
FIG. 2 is a left side elevation view of an oil pan according to the present invention.
Figure 3:
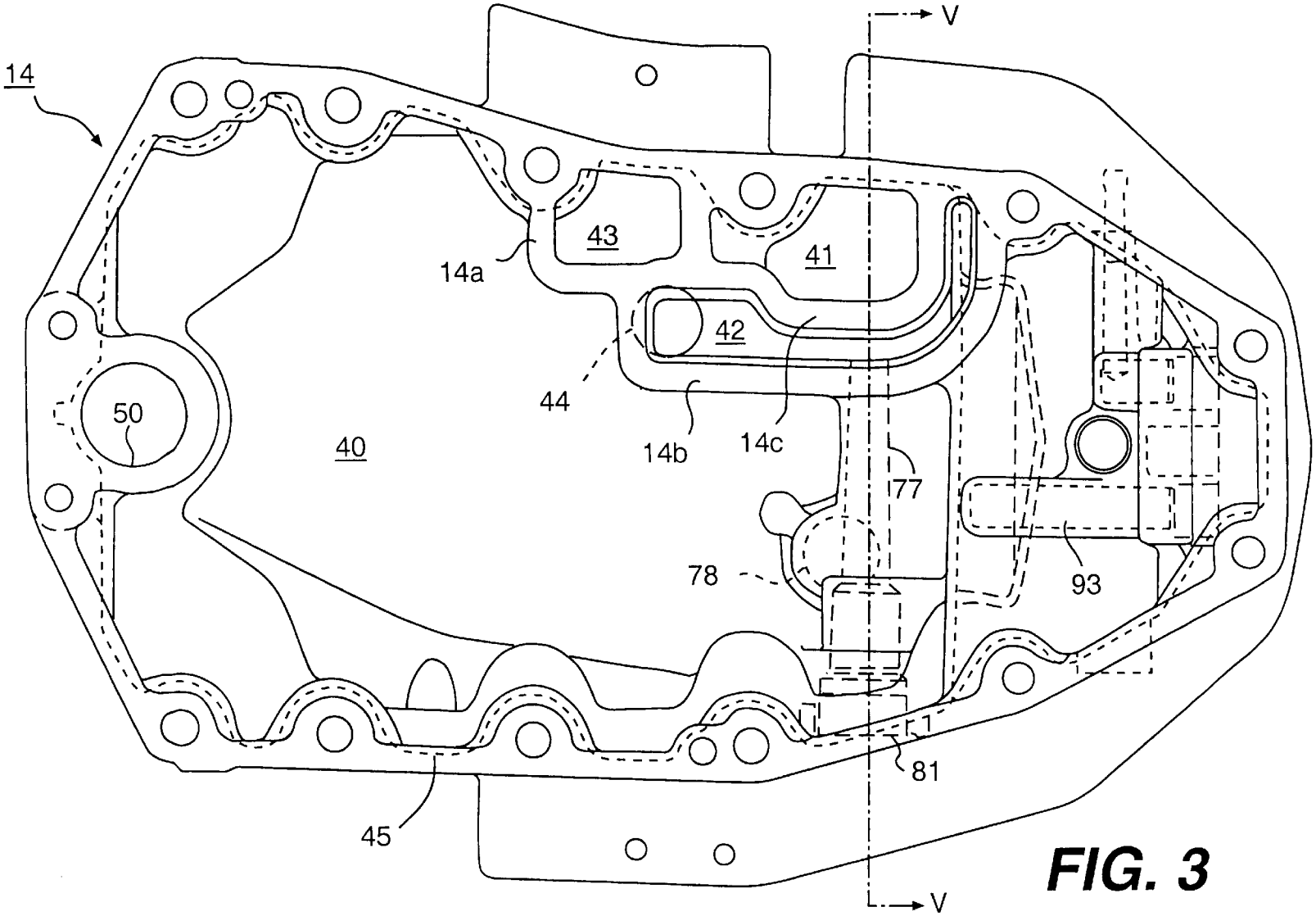
FIG. 3 is a top plan view of an oil pan according to the present invention.
Figure 4:
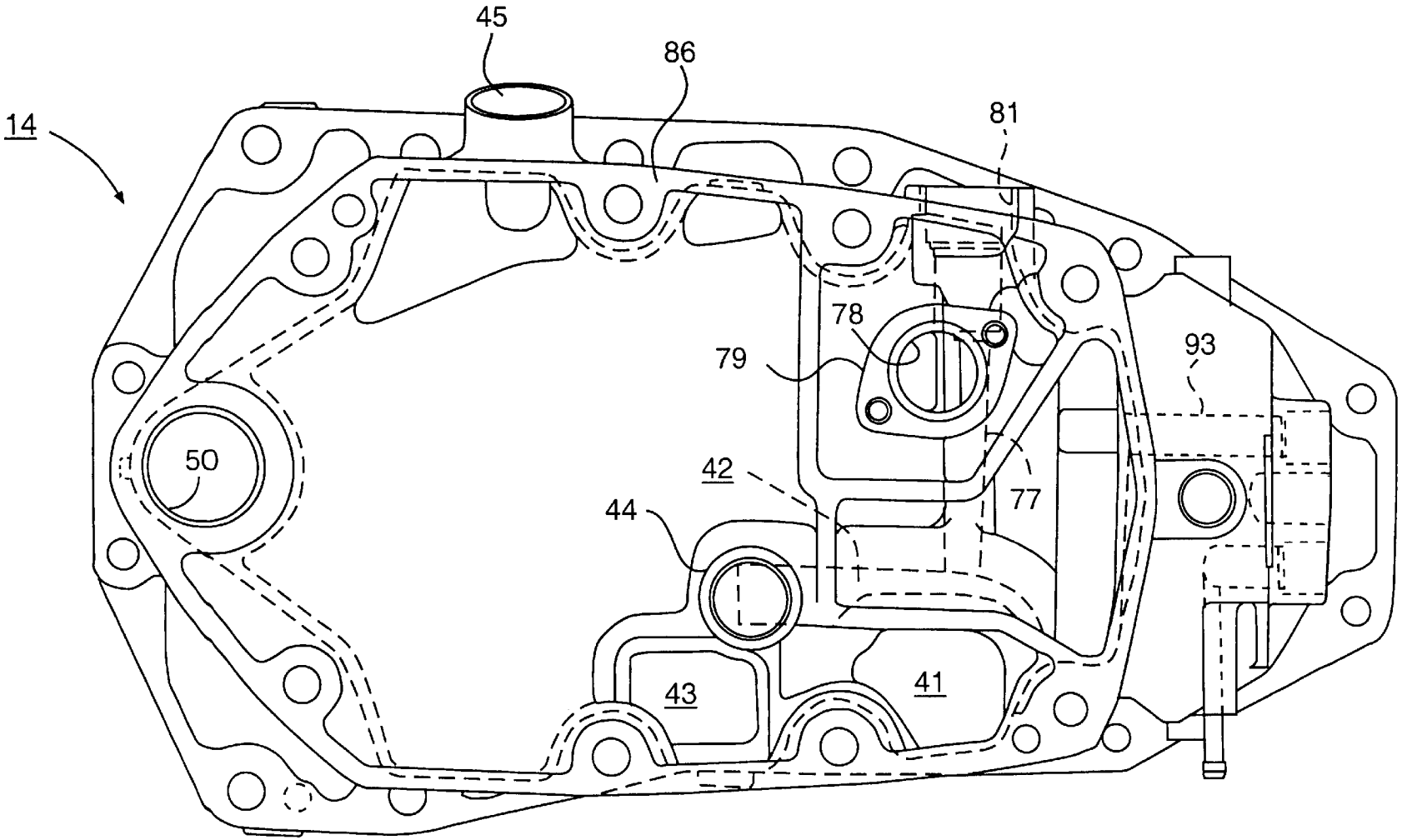
FIG. 4 is a bottom plan view of an oil pan according to the present invention.

FIG. 2 shows the left side of the oil pan (14), while FIG. 3 and FIG. 4 show the top and bottom, respectively, of the oil pan (14). Most of the space inside the oil pan (14) is occupied by the oil accumulation tank (40). The exhaust passage (41), the water supply passage (42), and the wastewater passage (43) are formed integrally at one end of the oil pan (14). These passages (41, 42, 43) extend down from the engine (6) and pass vertically through the oil pan (14). By forming vertical separation walls (14*a,* 14*b,* 14*c*) inside the oil pan, the oil pan can be molded as a single unit defining these passages.

Figure 5:
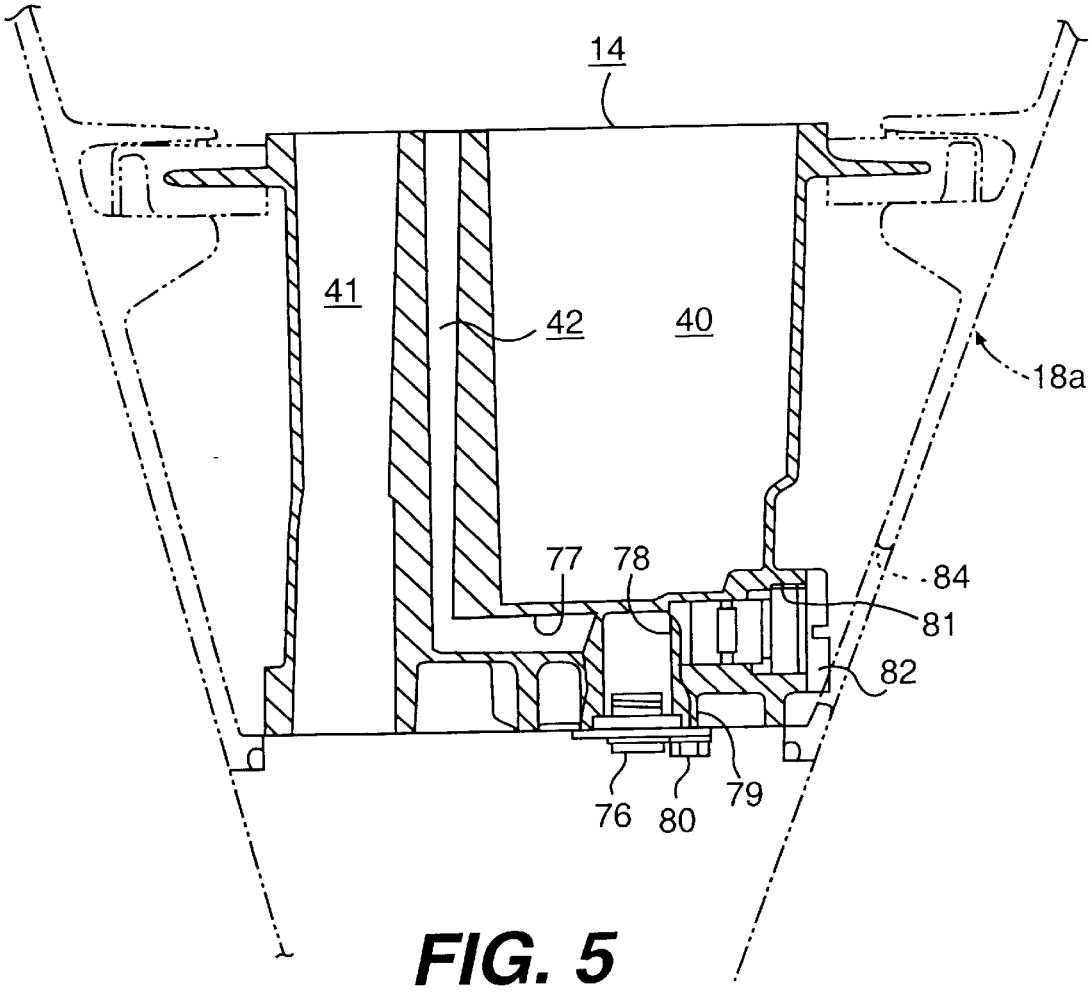
FIG. 5 is a cross section on line V—V of the oil pan of FIG. 3.

As shown in FIGS. 3–5, the water supply passage (42) and the wastewater passage (43) are formed so they surround the exhaust passage (41). For example, the water supply passage (42) has a cross section in the shape of an incomplete "L." When seen in the same section, the exhaust passage (41) is located in the corner of the "L" configuration, and the wastewater passage (43) is located in front of the exhaust passage (41), surrounding the exhaust passage on two sides.

A water supply joint (44) is provided at the bottom of the water supply passage (42) and is connected to the upper end of the water supply pipe (38), which extends from the water pump (35). An oil drain port (45) is provided on the left underside of the oil pan (14), and is used for discharging oil that is in the oil accumulation tank (40).

Figure 6:
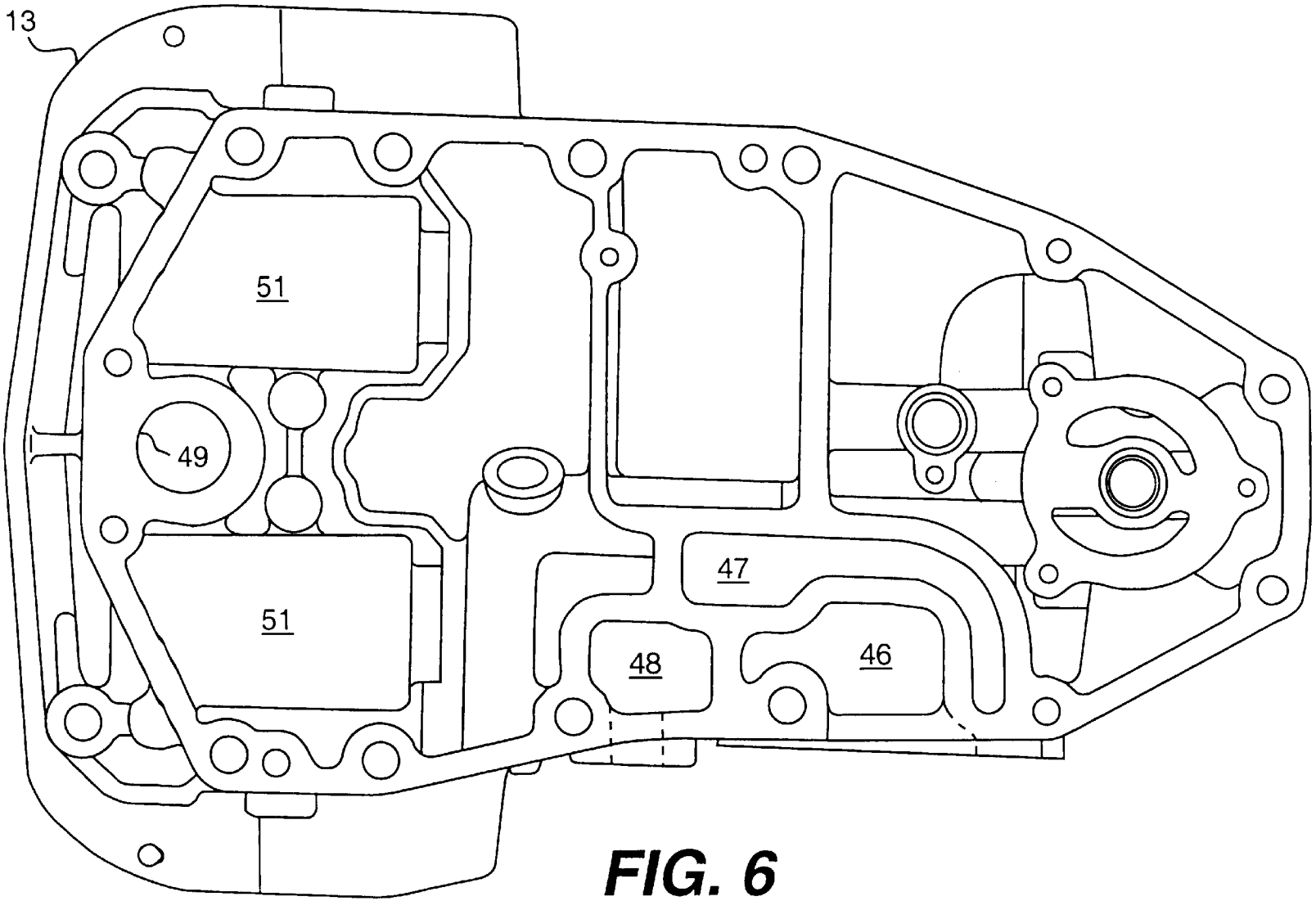
FIG. 6 is a bottom plan view of an engine holder used in the outboard motor shown in FIG. 1.

As shown in FIG. 6, an exhaust hole (46), a water supply hole (47), and a wastewater hole (48) are formed in the engine holder (13) adjacent to the oil pan. Also, drive shaft insertion openings (49, 50) into which the drive shaft is inserted are formed respectively in the front end portions of engine holder (13) and of oil pan (14). A left and right pair of mounting pedestals (51, 51) are provided in the front portion of the engine holder (13), where the outboard motor mounting member is attached.

Figure 7:
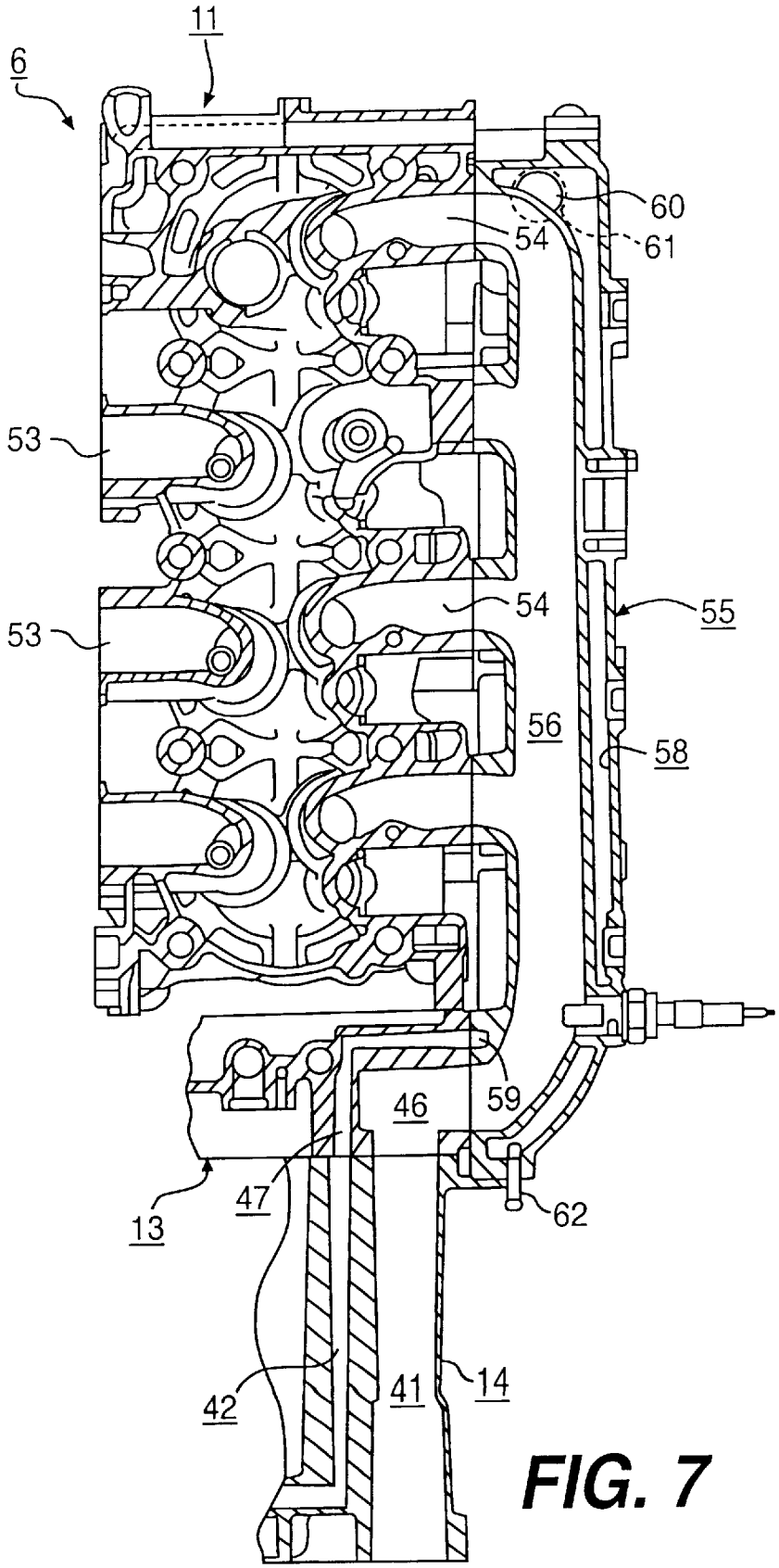
FIG. 7 is a cross section on line VII—VII of the engine shown in FIG. 1.
Figure 8:
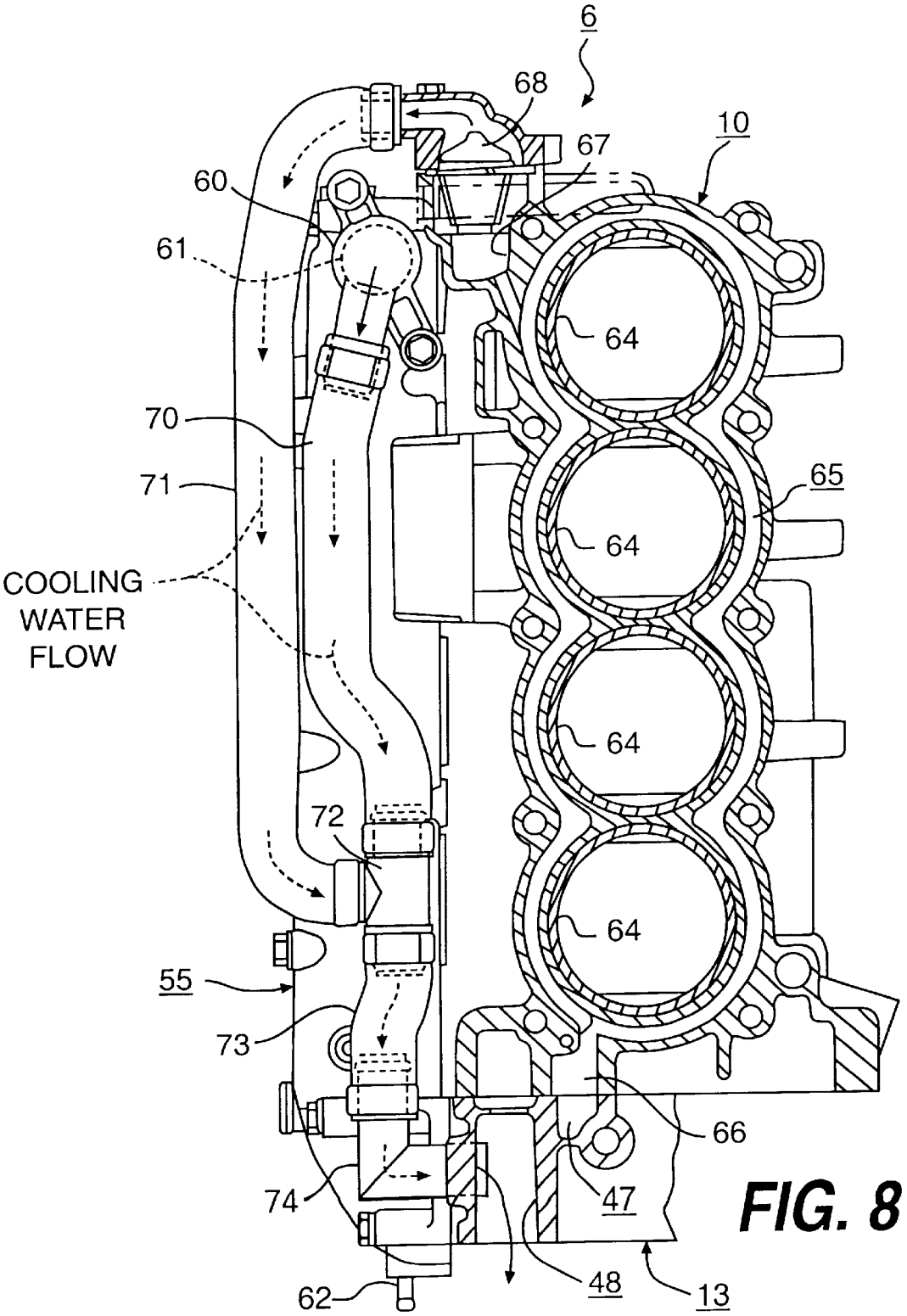
FIG. 8 is a cross section on line VIII—VIII of the engine shown in FIG. 1.

FIG. 7 and FIG. 8 are cross sectional drawings of engine (6) cut along lines VII—VII and VIII—VIII, respectively. As shown in FIG. 7, four air intake ports (53) are opened on the left side of the cylinder head (11) of engine (6), while four exhaust ports (54) are opened on the right side. Four air intake branches (26*a*) of an air intake device are connected to air intake ports (53), and an exhaust manifold (55) is fixed to exhaust ports (54).

Within the exhaust manifold (55) there is an exhaust collecting passage (56), and the exhaust ports (54) are attached to the exhaust collecting passage (56). The bottom ends of the exhaust manifold (55) are stacked on the right side of the engine holder (13), while the lowermost end of the exhaust collecting passage (56) curves on the engine holder (13) side and is attached to exhaust hole (46), which is opened on the left side of the engine holder (13). Thus, the exhaust gases travel from exhaust ports (54), to exhaust collecting passage (56), to exhaust hole (46), and finally to exhaust passage (41).

Cooling water flows through an exhaust water jacket (58) located around the exhaust collection passage (56). An inlet (59) is provided in the lowermost end of this exhaust water jacket (58), and an outlet (60) is provided in the uppermost part. A pressure relief valve (61) is provided within the outlet (60). A water sampling hole (62) is also provided in the lowermost part of the exhaust water jacket (58). A head water jacket (75) is provided to cool the cylinder head of the engine.

Four cylinders (64) are formed inside the cylinder block (10), as shown in FIG. 8. A block water jacket (65) surrounds the four cylinders (64), and cooling water flows through the jacket. An inlet (66) is provided in the lowermost part of the block water jacket (65), while an outlet (67) is provided in the uppermost part. A thermostat is provided inside the outlet (67).

The respective inlets (59, 66) of the exhaust waterjacket (58) and the block water jacket (65) are each attached to the water supply passage (42) of the oil pan via the respective water supply hole (47) of the engine holder (13). Also, wastewater hoses (70, 71) are connected at one end to the outlets (60, 67) while the other ends of the wastewater hoses (70, 71) come together in a wastewater hose (73) via a "T" shaped joint (72). The single wastewater hose (73) is connected to the wastewater hole (48) of the engine holder (13) via an "L" shaped joint (74), and from there connects to the wastewater passage (43) in the oil pan.

Figure 9:
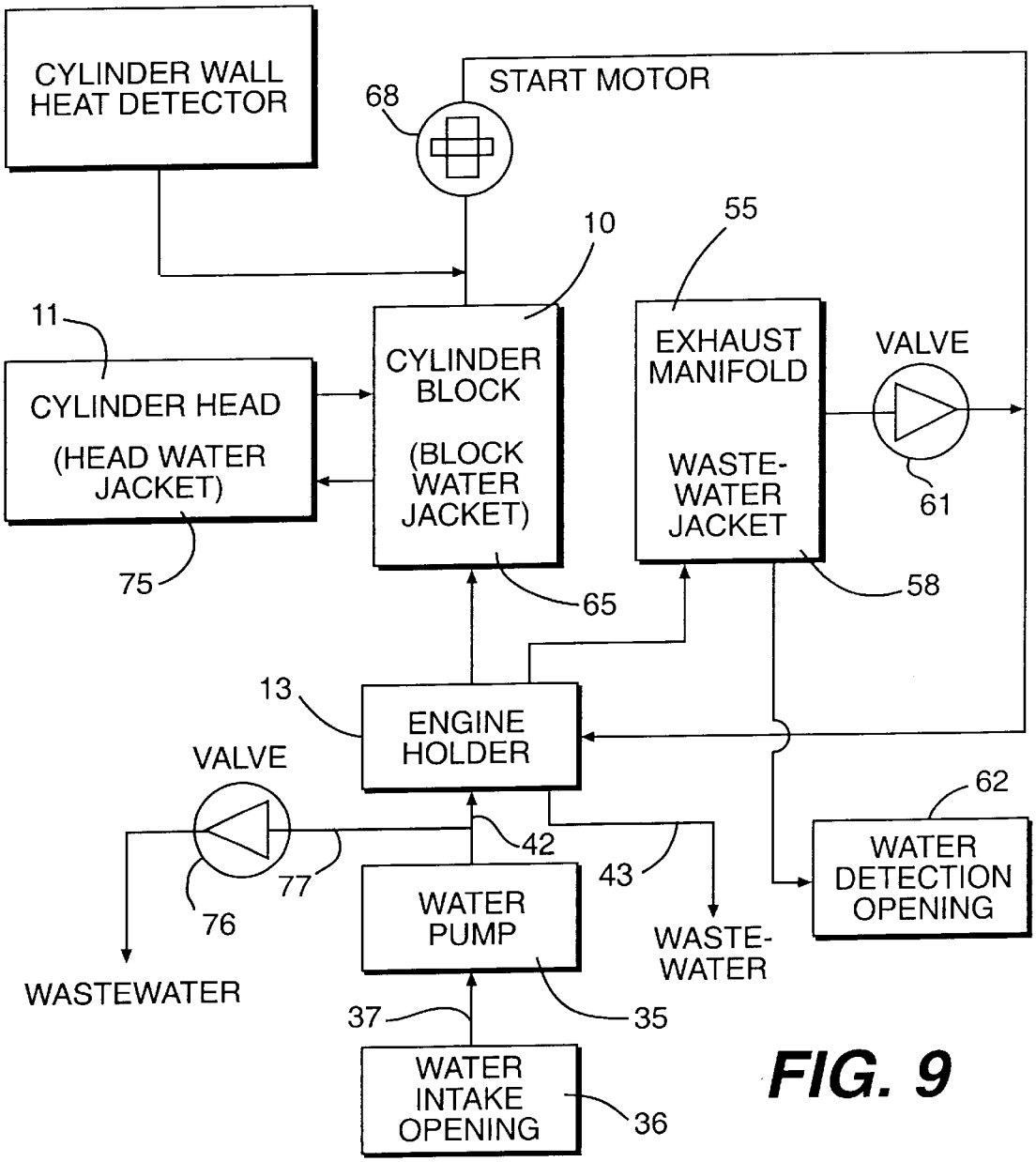
FIG. 9 is a block diagram showing the cooling water pathway according to the invention.

The cooling water pathway is structured in the manner shown in the schematic of FIG. 9. Moreover, as shown in that figure, the block water jacket (65) communicates with the head water jacket (75) formed in the cylinder head (11), whereby the cooling water circulates in both directions. A cylinder wall heat sensor is provided between the block water jacket (65) and the thermostat (68).

When the engine (6) operates, the rotation of the drive shaft (19) drives the water pump (35), external water is taken in as cooling water from the water intake opening (36) of the gear housing (16), and then flows along the cooling water passages corresponding to the schematic of FIG. 9. Thus, the exhaust water jacket (58), the block water jacket (65), and the head water jacket (75) are cooled.

The valve of thermostat (68) closes as the engine (6) cools. When the engine (6) operates and the cooling water temperature in the block waterjacket (65) and the head water jacket (75) increases to a given value, the thermostat valve opens and cooling water is allowed to circulate. In this manner, the warmup time of engine (6) can be shortened, and over-cooling of the cylinders (64) during operation can be prevented.

When the thermostat valve (68) is closed, the pressure on the downstream side of the water pump (35) rises above the normal operating pressure. Consequently, the pressure relief valve (76) shown in the cooling water passage in FIG. 9 opens, excess cooling water is released to the exterior to reduce pressure, and the cooling water passage is protected from excessively high pressures.

As shown in FIGS. 2–5, at the bottom of the oil pan (14) there is a flush passage (77) that extends horizontally from the left to right side of the oil pan (14), and that communicates with the bottom of the supply water passage (42). Formed in this flush passage (77) is a short valve passage (78) that extends downward. Pressure relief valve (76) is fixed by bolts (80) or similar fasteners to a valve pedestal (79) formed on the outer end of this valve passage (78) (see FIG. 5). Flush passage (77) has a large diameter inlet portion which becomes the flush port (81). This flush port (81) is sealed off by a removable plug (82) screwed into it as shown in FIGS. 1 and 5. When plug (82) is removed, a hose from an external water supply can easily be inserted into the flush port (81), so that the entire cooling water pathway can be washed using clean water.

The oil pan (14) is surrounded by lower cover (18*a*) of the engine cover. As depicted in FIG. 5, a flush hole (84) is formed in a position that corresponds to the lower cover's flush port (81), and the plug (82) that seals off the flush hole (81) is exposed to the outside via this flush hole (84).

Figure 10:
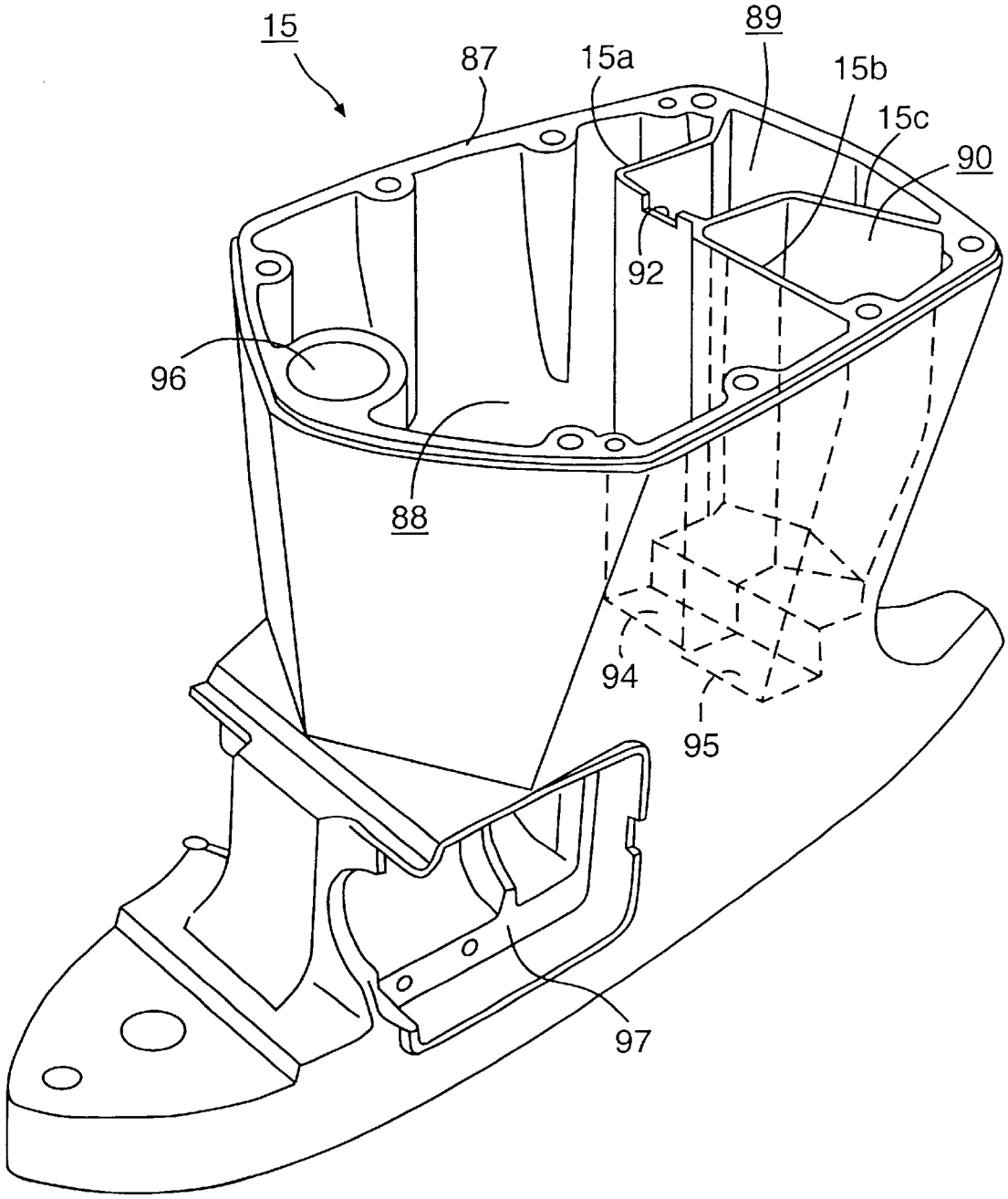
FIG. 10 is a perspective view of an embodiment of a drive shaft housing according to the invention.

As shown in FIG. 4, a flat connecting base (86) that connects with the top surface of the drive shaft housing (15) is formed in the bottom of the oil pan (14). As shown in FIG. 10, a connecting base (87) for connecting to the base of the oil pan (14) is formed on the top surface of the drive shaft housing (15). Also, formed within the drive shaft housing (15) are vertical walls (15*a,* 15*b,* 15*c*) which partition the drive shaft housing to match the layout of the internal passages of the oil pan.

Vertical walls (15*a,* 15*b,* 15*c*) section off the internal space of the drive shaft housing (15) into the main exhaust chamber (88), the exhaust release chamber (89), and the pressure valve chamber (90). The lower end of the exhaust passage (41) formed in the oil pan (14) is linked to the main exhaust chamber (88). Also, the lower part of the main exhaust chamber (88) is connected to a passage in the interior of gear housing (16), so that the exhaust gases pass through the interior of gear housing (16) and through the exhaust outlet passage (91) (see FIG. 1) that terminates through the center of the propeller (21).

A small notch (92) is formed in the top end of the vertical wall (15*a*) that defines the exhaust release chamber (89). The exhaust release chamber (89) is connected to the main exhaust chamber (88) by way of this notch (92). The exhaust release chamber (89) also connects to the exterior by way of the exhaust release passage (93) formed in the bottom surface of the oil pan (14). Moreover, openings (94, 95) are formed in the bottom of the exhaust release chamber (89) and the pressure valve chamber (90), to communicate with the main exhaust chamber (88).

Also, formed in the front edge of the drive shaft housing (15), there is a drive shaft insertion opening (96) into which the drive shaft (19) can be inserted. Mounting platforms (97, 97) are provided on both the left and right sides of the bottom of the drive shaft housing (15), to provide attachment points for the mounting member (24).

The exhaust gas flows from the exhaust passage (41) to the main exhaust chamber (88) of the drive shaft housing (15). If the engine (6) idles or operates at low velocity, water enters the main exhaust chamber (88) because the exhaust gas volume is minimal. Consequently, the exhaust gas enters the exhaust release chamber (89) from the main exhaust chamber (88) via the notch (92). At this point, the exhaust gas passes through the exhaust release passage (93) and is released externally.

When the engine (6) operates at medium to high speed, the rotation of the propeller (21) forces water out of the main exhaust chamber (88), lowering the water level so that resistance to the exhaust gas emission is minimal. The exhaust gas volume increases, and after most of the exhaust gas expands in the main exhaust chamber, it is released into the water from the central part of the propeller (21), after passing through the exhaust outlet passage (91) of the gear housing.

The pressure valve chamber (90) is shaped such that it surrounds the pressure relief valve (76) provided on the underside of the oil pan (14). Accordingly, wastewater from the pressure relief valve (76) flows down within the pressure valve chamber (90), is emitted from the opening (95), and is released externally via the exhaust outlet passage (91).

In an outboard motor (1), as described, the exhaust passage (41) and the water supply passage (42) for cooling water that extend down from the engine, as well as the wastewater passage (43), are molded as a single unit with the oil pan (14). Thus, there is no need to provide separate piping material for each of the exhaust passage, the water supply passage, and the waste water passage, as is done in conventional outboard motors. In this design, several parts are completely unnecessary, such as piping material, fixing bolts to fasten the piping material, gaskets to protect airtightness, and so on.

Because the water supply passage (42) and the wastewater passage (43) surround the exhaust passage (41), cooling water that flows through the water supply passage (42) and the wastewater passage (43) completely shields the oil accumulated in the oil pan from the high temperatures emanating from the exhaust passage (41). Consequently, the oil is unaffected by exhaust heat, and does not suffer a reduction in life span and lubrication performance.

In this outboard motor design, a pressure relief valve (76) that adjusts the water pressure of the cooling water passage is provided in the bottom of the oil pan (14). This pressure relief valve (76) is positioned just downstream from the water pump (35) in the cooling water pathway, so that even if pressure generated by the water pump (35) exceeds certain limits, water will be released by the pressure valve, and the pressure in the overall cooling system will not become too high. As a result, the loading on gaskets located in the cooling water pathway can be reduced, and cooling water leakage can be prevented.

Pressure relief valve (76) is positioned on the underside of the oil pan (14), within a pressure valve chamber (90). Wastewater flows down from the pressure relief valve (76), into the pressure valve chamber (90) provided in the drive shaft housing (15), just below the oil pan (14). Thus, exhaust gas that flows through the main exhaust chamber (88) inside the drive shaft housing (15) does not come into direct contact with the pressure relief valve (76) and its rubber seals. Also, the flow of water discharged from the pressure relief valve (76) cannot be obstructed by the exhaust gas, and thus the full use of the pressure relief valve (76) can be made.

Flush port (81) used to wash the cooling water pathway is provided on the outer surface of oil pan (14). The plug (82) that seals off flush port (81) is exposed externally. It is thus unnecessary to provide additional piping connected to the flush port (81), and so the structure surrounding the flush port can be simplified. Also, if plug (82) is removed, the operation of washing the cooling water pathway can begin immediately without removing any engine covers, and the entire washing operation is simplified.

The outboard motor of the present invention is designed so that the exhaust passage and the water supply passage for cooling water, as well as the wastewater passage, can be molded as a single unit with the oil pan. Thus, it is not necessary to provide different pipe material for each of the exhaust passage, the water supply passage, and the wastewater passage, as in conventional outboard motors. The number of parts needed can be greatly decreased, assembly man hours and weight can be reduced, and the structure of the motor is extremely simple and lightweight.

The water supply passage and the wastewater passage of the present invention are formed to surround the oil pan's exhaust passage. Thus, cooling water flowing through the water supply passage and the wastewater passage protects the oil accumulated in the oil pan from the heat of the exhaust gas, and prevents reduction of oil life span and lubrication performance.

A pressure relief valve to adjust the water pressure of the cooling water's pathway is provided on the bottom of the oil pan, so that the pressure valve is positioned directly downstream from the water pump. Accordingly, even if the water pump's water pressure exceeds given limits, excess water pressure can be released by the pressure valve near the pump. Thus, the load on gaskets found in various locations in the entire cooling water pathway is diminished, and cooling water leakage is also prevented.

It will be apparent to those skilled in the art that various modifications and variations can be made in the structure of the present invention without departing from the spirit or scope of the invention. Thus, it is intended that the present invention cover the modifications and variations of this invention provided they come within the scope of the appended claims and their equivalents.

What is claimed is:

1. An outboard motor comprising:

an engine having an exhaust manifold, an inlet for receiving cooling water to cool the engine, and an outlet for releasing the cooling water as waste water; and an oil pan unit under the engine, the oil pan unit comprising an oil reservoir, an exhaust passage communicating with the exhaust manifold, a cooling water passage communicating with the inlet to flow water from the inlet to the engine, and a waste water passage communicating with the outlet;

wherein the cooling water passage includes a surface in contact with at least two sides of the exhaust passage, and the waste water passage includes a surface in contact with at least another side of the exhaust passage.

2. The outboard motor of claim 1, wherein the cooling water passage and the waste water passage at least partially surround the exhaust passage on three sides.

3. The outboard motor of claim 2, wherein the cooling water passage and the waste water passage surround the exhaust passage on sides facing the oil reservoir .

4. The outboard motor of claim 1, further comprising:

a flush port connected to the cooling water passage for flushing the cooling system, the flush port opening on an outer surface of the oil pan unit; and a plug for sealing the flush port, the plug being exposed to the outside of the motor.

5. An outboard motor comprising:

an engine having an exhaust manifold, an inlet for receiving cooling water to cool the engine, and an outlet for releasing the cooling water as waste water; and an oil pan unit under the engine, the oil pan unit comprising an oil reservoir, an exhaust passage communicating with the exhaust manifold, a cooling water passage communicating with the inlet, and a waste water passage communicating with the outlet; and further comprising a pressure valve for controlling the cooling water passage pressure, located adjacent a bottom surface of the oil pan unit.

6. The outboard motor of claim 5, further comprising a drive shaft housing complementary to the oil pan unit, and defining a pressure valve chamber where the pressure valve opens.

* * * * *